US005104123A

United States Patent [19]

Okitsu et al.

[11] Patent Number: 5,104,123

[45] Date of Patent: Apr. 14, 1992

[54] METAL BAT FOR USE IN BASEBALL

[75] Inventors: Masatoyo Okitsu; Katsuji Kitagawa, both of Kasukabe; Masao Kubo, Koshigaya; Toshiyuki Arisato, Iwakuni, all of Japan

[73] Assignee: Somar Corporation, Japan

[21] Appl. No.: 607,688

[22] Filed: Nov. 1, 1990

[30] Foreign Application Priority Data

Jun. 8, 1990 [JP] Japan ..... 2-61238[U]

[51] Int. Cl.[5] ..... A63B 59/06

[52] U.S. Cl. ..... 273/72 A; 273/80.4; 273/80.8; 427/236; 427/239

[58] Field of Search ..... 128/72, 911, 80.4, 80.8, 128/82 R, 84; 81/422, 989; 427/236, 239, 233, 234

[56] References Cited

U.S. PATENT DOCUMENTS 2,452,557 11/1948 Eller ..... 273/72 A
3,228,687 1/1966 Bauer ..... 273/72 A
3,727,295 4/1973 Gildemellter ..... 273/72 A
3,861,692 1/1975 Fujii ..... 273/72 A
3,876,204 4/1975 Moore et al. ..... 273/72 A

FOREIGN PATENT DOCUMENTS 62-21380 2/1987 Japan .

OTHER PUBLICATIONS

Carly Bates Co. "Easton Aluminum Bats", 1974 (Advertisement).

*Primary Examiner*—Edward M. Coven
*Assistant Examiner*—Mark S. Graham
*Attorney, Agent, or Firm*—Lorusso & Loud

[57] ABSTRACT

A metal bat for use in baseball is disclosed which includes a tubular metal body having an impact portion for hitting a ball, and a layer of a resin foam provided on and bonded to the inside wall of the impact portion and having a density of 0.05–0.5 g/cm$^3$.

5 Claims, 1 Drawing Sheet

METAL BAT FOR USE IN BASEBALL

BACKGROUND OF THE INVENTION

This invention relates to a metal bat for use in baseball and to a method of producing same.

Baseball bats formed of tubular metal bodies are now widespread among students' or other baseball players. Known baseball bats, however, have a problem because a sharp metallic sound is generated when hitting a ball therewith. To cope with this problem, Japanese Published Unexamined Utility Model Application No. 62-21380 proposes to provide a layer formed of an inorganic fiber-reinforced material, such as a glass fiber-reinforced rubber, on an inside wall of a tubular metal bat. While this metal bat lined with such a sound-proofing layer of an inorganic fiber-reinforced material can solve the problem of metallic, impact sound, another problem arises because the sound-proofing layer tends to change the center of gravity of the bat. Furthmore, it is impossible to newly provide such a sound-proofing layer in bats already completed as commercial products.

SUMMARY OF THE INVENTION

It is, therefore, an object of the present invention to provide a metal bat which is devoid of the drawbacks of the conventional metal bat.

It is a particular object of the present invention to provide a metal bat whose impact sound upon hitting a ball may be reduced without changing the balance and weight thereof.

It is a further object of the present invention to provide a method of producing metal bats of above-mentioned type in which commercially available, completed bat or already used bats thereof may be used as raw material bats.

In accomplishing the foregoing objects, there is provided in accordance with the present invention a metal bat for use in baseball, comprising a tubular metal body having an impact portion for hitting a ball, and a layer of a resin foam provided on and bonded to the inside wall of said impact portion and having a density of 0.05–0.5 g/cm$^3$.

In another aspect, the present invention provides a method of producing a metal bat for use in baseball, comprising the steps of:

(a) providing a baseball bat having a tubular metal body which is closed at both a grip end and the opposite end thereof and which has an impact portion for hitting a ball;

(b) providing an expandable, powder coating composition;

(c) forming in said grip end an opening of a size permitting a spray nozzle to be inserted therethrough;

(d) heating said impact portion to a temperature so that said powder coating composition can be adhered to the inside wall of said impact portion;

(e) inserting said spray nozzle through said opening and spraying said powder coating composition through said nozzle into the inside of said tubular metal body to form a coating of the powder coating composition on the inside of said impact portion;

(f) heating said impact portion whose inside wall has been provided with said coating to a temperature sufficient to expand said coating; and (g) closing said opening.

BRIEF DESCRIPTION OF THE DRAWINGS

Other objects, features and advantages of the present invention will become apparent from the detailed description of the preferred embodiments of the invention which follows, when considered in light of the accompanying drawing, in which.

DETAILED DESCRIPTION OF THE PREFERRED EMBODIMENTS OF THE INVENTION

Figure 1:
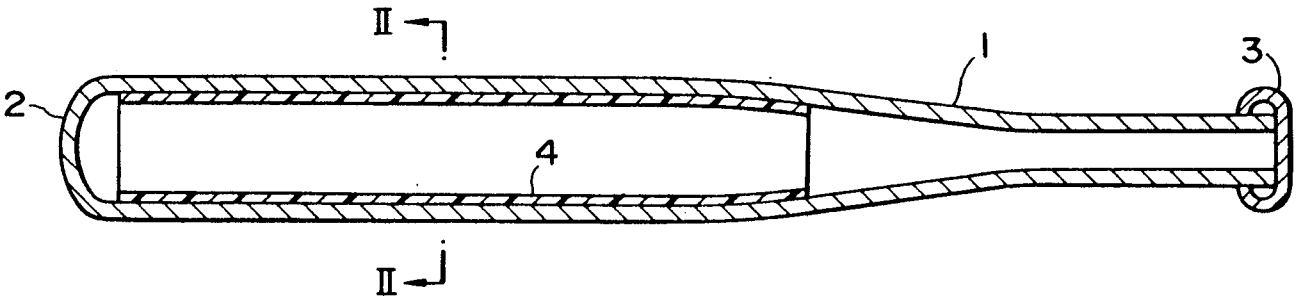
FIG. 1 is an axial cross-sectional view schematically illustrating one embodiment of a metal bat according to the present invention.
Figure 2:
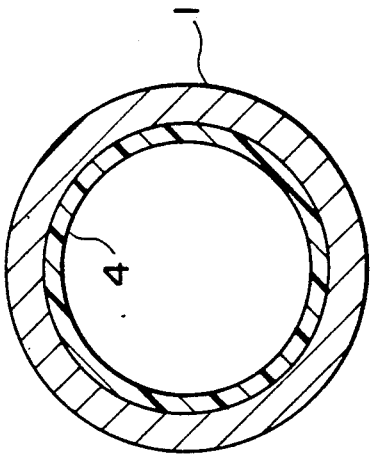
FIG. 2 is a sectional view taken on the line II—II in FIG. 1.

Referring now to FIGS. 1 and 2, the reference numeral 1 denotes a tubular metal body formed, for example, of an aluminum alloy such duralumin. Any known structure for the tubular metal body may be used in the present invention. In the particular case as illustrated in FIG. 1, the tubular metal body 1 has a closed end 2 at its head, a large diameter portion serving as an impact portion, a tapered portion, a small diameter portion to be gripped by a batter and a closed end serving as a grip end 3.

Provided on and bonded to the inside wall of the impact portion for hitting a ball is a layer 4 formed of a resin foam and having a density of 0.05–0.5 g/cm$^3$, preferably 0.1–0.3 g/cm$^3$. The resin foam layer 4 serves to absorb the sound wave generated by impact of the bat with a ball and functions as a sound-proofing layer. At least 0.05 g/cm$^3$ is necessary to provide satisfactory sound-proofing effect. A density of the resin form layer 4 in excess of 0.5 g/cm$^3$, on the other hand, is disadvantageous because the weight of the layer 4 is increased to such an extent that it adversely affect the balance of the bat. The resin foam layer 4 generally has a thickness of about 0.1–4 mm, preferably 0.5–2 mm.

It is preferred that the resin foam layer 4 be a foamed coating of a powder coating composition. Particularly preferred is the use of a powder coating composition which includes (a) a resin containing a hydroxyl group-containing polymer, (b) a cross-linking agent containing a polyisocyanate compound which is capable of reacting with the hydroxyl groups of the hydroxyl group-containing polymer at a temperature higher than the melting point of the resin to crosslink the hydroxyl group-containing polymer and which is solid at room temperature, and (c) a blowing agent capable of decomposing and generating a gas when heated to a temperature higher than the melting point of the resin.

The resin (a) which serves, upon expansion, as a structural material is a thermoplastic or thermosetting resin, preferably a hydroxyl group-containing polymer or a mixed polymer containing same. Examples of suitable hydroxyl group-containing polymer include polyvinyl alcohols, partially saponified ethylene/vinyl acetate copolymers and polyvinyl butyral resins. Such polymers preferably have a weight average molecular weight of about 10,000–100,000, more preferably about 35,000–80,000.

For the purpose of improving bonding of a foamed layer 4 obtained from the coating composition to the inside wall of the tubular metal body 1, it is preferred that the hydroxyl group-containing polymer further contain carboxyl groups. Such a polymer containing both hydroxyl and carboxyl groups can be obtained by conducting the polymerization for the production of the above hydroxyl group-containing polymer in the presence of an unsaturated carboxylic acid, such as maleic anhydride, acrylic acid, methacrylic acid or itaconic acid. Alternatively, grafting of such an unsaturated carboxylic acid onto the above hydroxyl group-containing polymer can give a polymer containing both hydroxyl and carboxyl groups.

The resin (a) may further contain a hydroxyl group-free polymer such as a polyolefin, an ethylene/vinyl acetate copolymer, a polyvinyl chloride or an ethylene/ethyl acrylate copolymer. Examples of suitable polyolefins include polyethylenes, ethylene/propylene copolymers, polypropylenes and polybutene-1. When such a hydroxyl group-free polymer is used, the amount of the hydroxyl group-containing polymer in the resin (a) is generally 50% by weight or more, preferably 60% by weight or more.

The resin (a) is preferably used in conjunction with a viscosity controlling agent which can control the viscosity of the coating composition in a molten state to facilitate the exapnsion thereof. A polyol compound which is solid or semi-solid at room temperature is preferably used as the viscosity controlling agent.

Illustrative of suitable polyol compounds are: ether-containing diols having the following formula (I):

$$HO\text{-}(C_mH_{2m}O)_n\text{-}H \qquad (I)$$

wherein m is a positive integer, preferably of 2–6, more preferably 3–4 and n is an integer of at least 2, preferably 4–6, ester-containing diols having the following formula (II):

$$\underset{OH}{HO}\text{-}(CH_2)_4\text{-}CO\text{-}O\text{-}_q\ R\text{-}O\text{-}CO\text{-}(CH_2)_r\text{-}_q \qquad (II)$$

wherein R stands for an alkylene having 2–10 carbon atoms, q is an integer of 1 or more, preferably 3–4, and r is an integer of 1 or more, preferably 3–7, and polymers having a saturated hydrocarbon skeleton and a molecular weight of 1000–5000 and containing 1.5–3 terminal hydroxyl groups. The polyol compound is used in an amount of 5–100 parts by weight, preferably 20–60 parts by weight per 100 parts by weight of the thermoplastic resin. The molecular weight of the polyol compound is generally about 300–6,000, preferably about 2,000–5,000.

Any polyisocyante compound which is solid at room temperature and which has two or more isocyante groups may be used as the cross-linking agent (b). Examples of the polyisocyanate compounds include phenylenediisocyanate, tolylenediisocyante, biphenylenediisocyanate and diphenylmethane-p,p-diisocyanate. Blocked polyisocyante compounds having their isocyanate groups blocked with an active hydrogen-containing compound such as an amide, a lactam, phenol, an alcohol, an oxyme or a mercaptane can also be suitably used for the purpose of the present invention. ϵ-Caprolactam is a particularly preferred active hydrogen-containing compound. For example, a compound having the formula (I):

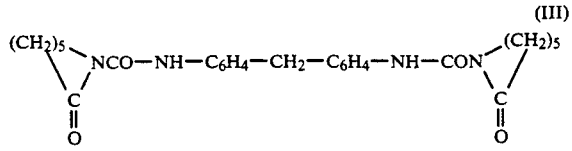

(III)

may be suitably used as the cross-linking agent (b).

The polyisocyante compound or its blocked derivative can react with the hydroxyl groups of the hydroxyl group-containing polymer to cross-link same. It can also react with the polyol compound which is optionally contained in the coating composition to form high molecular weight compounds. The polyisocyanate compound is used in an amount providing a ratio (NCO/OH) of equivalents of the isocyanate group per equivalent of the hydroxyl group in the composition of less than 1, preferably 0.03–0.8.

The cross-linking agent may further contain an organic peroxide in an amount of 0.5–7.0 parts by weight, preferably 1.0–4.0 parts by weight per 100 parts by weight of the resin (a). The organic peroxide may be, for example, dicumyl peroxide, bis(t-butylperoxy)isopropylbenzene, dimethyldi(t-butylperoxy)hexane or dimethyldi(t-butylperoxy)hexyne.

The blowing agent (c) may be an organic one such as azodicarbonamide, 2,2'-azobisisobutyronitrile, dinitrosopentamethylenetetramine, 4,4'-oxybisbenzene-sulfonyl hydrazide or paratoluenesulfonyl hydrazide, or an inorganic one such as sodium bicarbonate, ammonium carbonate, sodium borohydride or silicon oxyhydride. These blowing agents may be used by themselves or as a mixture of two or more. When the blowing agent used has a high decomposition temperature, the use of an expansion aid such as zinc oxide is effective in lowering the decomposition temperature. In the coating composition of the present invention, it is desirable to use several kinds of crosslinking agents together with an expansion aid for reasons of broadening the temperature range in which the composition is able to be expanded and of permitting the expansion to proceed uniformly even when the temperature at which the expansion is performed fluctuates.

The coating composition may further contain various additives such as a filler, a plasticizer, a coloring agent, a free flow improving agent and an antioxidant.

As the fillers, both organic and inorganic ones may be used. The viscosity of the coating composition in a molten state, and the diameter of cells and the mechanical strength of an expanded body obtained from the coating composition may be controlled by controlling the amount and the particle size of the filler to be added. Illustrative of suitable fillers are powders of zirconium, talc, crystalline silica, fused silica, calcium carbonate, magnesia, calcium silicate, aluminum hydroxide, magnesium hydroxide, phenol resins and silicone resins.

Illustrative of suitable plasticizers are chlorinated paraffins, dioctylphthalate, diethylene glycol dibenzoate and dicyclohexylphthalate. Other customarily employed plasticizers may also be used. These plasticizers can impart desired cushioning property (elasticity) and flexibility to the coatings obtained from the coating composition.

The coating composition may be obtained by mixing and kneading the above components with each other at a temperature higher than the melting point of the resin, pelleticizing the kneaded mixture, and grinding the pellets. In order to prevent the occurrance of expansion during the mixing stage, a mixing temperature of less than the decomposition temperature of the blowing agent is adopted. Further, the mixing is desired to be carried out at a temperature lower than the temperature at which the cross-linking occurs so that the occurrence of cross-linking is substantially prevented.

The coating composition preferably has such a particle size distribution that the content of particles with a particle size of 40 mesh (Tyler) or finer is 100% by weight, the content of particles with a particle size of 200 mesh or finer is at least 50% by weight and the content of particles with a particle size of 325 mesh or finer is not greater than 50% by weight, for the purpose of improving the free flow property of the coating composition and thereby facilitating the deposition of the coating composition onto a substrate during the powder coating stage.

The coating of the tubular metal body 1 with the coating composition may be carried out at a temperature sufficient to decompose the blowing agent, to cross-link the resin and to cause said coating composition to expand, thereby to form a layer of the expanded resin over the surface of the substrate. The powder coating may, for example, be carried out by contacting the inside wall of the tubular body 1 which has been preheated to a temperature higher than the decomposition temperature of the blowing agent with the coating composition. By this, the powder of the coating composition deposits on the inside surface of the tubular body 1 and the deposits are melted and undergo both cross-linking and expansion, thereby forming a foamed layer 4. The expansion ratio of the foamed layer may be controlled by the amount of the blowing agent in the coating composition and is preferably 2–20, more preferably 3–10.

The use of the powder coating composition permits the formation of a resin foam layer on the inside wall of a tubular metal body which is closed at both ends. For example, a resin foam layer may be formed on the inside wall of a metal bat which is available in the completely manufactured product as follows.

At first, a small opening is formed in the grip end by, for example, drilling. The size of the opening is such as to permit a spray nozzle for spraying a powder coating composition to be inserted therethrough. The impact portion of the metal bat is heated to a temperature so that the powder coating composition can be adhered to the inside wall of the impact portion. The heating may be effected by means of a coil heater or a band heater.

Then the spray nozzle is inserted into the opening and the powder coating composition is sprayed therefrom into the inside space of the metal bat. The powder coating composition is thus adhered to the heated surface of the metal bat to form a deposit layer on the inside wall of the impact portion of the metal bat. The thickness of the deposit layer may be controlled by control of the temperature of the heated surface and the spraying time. The powder coating composition remaining unadhered in the metal bat is removed therefromal through the opening.

Then the impact portion whose inside wall has been provided with the deposit layer of the powder coating composition is heated to a temperature sufficient to cross-link and expand the deposit layer and thereby to form a foamed resin layer on the inside wall of the impact portion of the bat. This expansion treatment may be effected by, for example, using an oven.

Thereafter, the opening in the grip end is closed, for example, by welding. The protruded portion if present is removed by grinding or calendering, thereby obtaining a metal bat according to the present invention.

The following examples will further illustrate the present invention.

REFERENCE EXAMPLE

Preparation of Powder Coating Composition

To 60 parts by weight of a partially saponified ethylene/vinyl acetate copolymer (saponification degree: 80%) were mixed 40 parts by weight of ethylene/vinyl acetate copolymer (vinyl acetate content: 30% by weight, Melt Flow Index: 18 g/10 minutes), 60 parts by weight of calcium carbonate as a filler, 5 parts by weight of a blend of azodicarbonamide as a blowing agent with zinc oxide as an expansion aid, 30 parts by weight of a dioctyl phthalate-containing plasticizer, 6 parts by weight of a blocked isocyanate 0.5 part by weight of dibutyl laurate as a cross-linking promoter and 1.7 parts by weight of dicumylperoxide as a cross-linking agent, and 0.5 part by weight of carbon black as a coloring agent. The thus obtained mixture was mixed in a dry state and then melt-extruded at a temperature of 130° C. with an extruder. The extrudate was cooled, pelleticized and then ground at −80° C. to obtain a coating composition in the form of fine powder. The coating composition was found to have such a particle size distribution that the content of particles with a particle size of 40 mesh (Tyler) or finer is 100% by weight, the content of particles with a particle size of 200 mesh or finer is at least 50% by weight and the content of particles with a particle size of 325 mesh or finer is not greater than 50% by weight.

EXAMPLE 1

A duralumin bat (finished product) was used as a starting material. The grip end was drilled to form an opening. After the impact portion of the bat had been heated by means of a band heater to 135° C., 20 g of the powder coating composition obtained in the above Reference Example was sprayed into the bat through the opening using a spray nozzle to coat the inside wall of the impact portion of the bat. The bat was then placed in an oven and heated to 160° C. for 30 minutes to expand and cross-link the coating. After pluging the opening, the bat lined with the expanded coating (sound proofing layer) was subjected to batting tests. Further, the bat was cut to measure the thickness of the expanded coating. The results are shown in Table 1. The batting tests were carried out by hitting balls thrown at a speed of 100 km/second by a batting machine to measure the carry and the duration of impact sound.

EXAMPLE 2

An impact portion of a tubular duralumin body open ended at its both ends (an unfinished product of the bat used in Example 1) was heated to 135° C. A spray nozzle was inserted through a head portion of the bat and 20 g of the coating composition obtained in Reference Example was spray coated over the inside wall of the impact portion. The tubular body was then placed in an oven and heated to 160° C. for 30 minutes to expand and cross-link the coating. The open end head portion was closed in a manner known per se and a grip end member was attached to the opposite open end. The bat thus lined with the expanded coating (sound-proofing layer)

was subjected to batting tests. Further, the bat was cut to measure the thickness of the expanded coating. The results are shown in Table 1.

COMPARATIVE EXAMPLE 1

To 100 parts by weight of an epoxy resin composition was blended 3.6 parts by weight of a polyester elastomer (HIGHTRELL 4057 manufactured by duPont Inc.) and the blend was dissolved in a solvent to form a solution with a resin content of 75% by weight. An non-woven polyester fabric (thickness: 0.47 mm, weight: 63 g/m$^2$) was then impregnated with the above solution and heated at 130° C. for 5 minutes to obtain a prepreg.

Into a tubular duralumin body open ended at its both ends (unfinished product as used in Example. 2) was inserted the prepreg. The prepreg was applied onto the inside wall of the impact portion of the tubular body and laminated to form three-ply layer. While pressing the layer against the wall of the tubular body, the tubular body was heated at 100° C. for 1 hour to harden the prepreg layer. The open end head portion was then closed in a manner known per se and a grip end member was attached to the opposite open end. The bat thus lined with the fiber-reinforced plastic layer (sound proofing layer) was subjected to batting tests. The results are shown in Table 1.

TABLE 1

| | Sound Proofing Layer | | | Sound | |
|---|---|---|---|---|---|
| | Density (g/cm$^3$) | Thickness (mm) | Weight (g) | Proofing Property | Carry Power |
| Example 1 | 0.40 | 1 | 20 | excellent | good |
| Example 2 | 0.40 | 1 | 20 | excellent | good |
| Comp. Ex. | 1.35 | 1 | 63 | good | good |

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

What is claimed is:

1. A metal bat for use in baseball, comprising a tubular metal body having an impact portion for hitting a ball, and a layer of a foamed coating of a powder resin coating composition, provided on and bonded to the inside wall of said impact portion and having a density of 0.05–0.5 g/cm$^3$.

2. A metal bat according to claim 1, wherein said powder coating composition comprises a thermoplastic resin containing a hydroxyl group-containing polymer, a cross-linking agent containing a polyisocyanate compound which is capable of reacting with the hydroxyl groups of said polymer at a temperature higher than the melting point of said thermoplastic resin to crosslink said polymer and which is solid at room temperature, and a blowing agent capable of decomposing and generating a gas when heated to a temperature higher than the melting point of said thermoplastic resin.

3. A method of producing a metal bat for use in baseball, comprising the steps of:

(a) providing a baseball bat having a tubular metal body which is closed at both a grip end and the opposite end thereof and which has an impact portion for hitting a ball;

(b) providing an expandable, powder coating composition;

(c) forming in said grip end an opening of a size permitting a spray nozzle to be inserted therethrough;

(d) heating said impact portion to a temperature so that said powder coating composition can be adhered to the inside wall of said impact portion;

(e) inserting said spray nozzle through said opening and spraying said powder coating composition through said nozzle into the inside of said tubular metal body to form a coating of the powder coating composition on the inside of said impact portion;

(f) heating said impact portion whose inside wall has been provided with said coating to a temperature sufficient to expand said coating; and (g) closing said opening.

4. A method according to claim 3, wherein said powder coating composition comprises a thermoplastic resin containing a hydroxyl group-containing polymer, a cross-linking agent containing a polyisocyanate compound which is capable of reacting with the hydroxyl groups of said polymer at a temperature higher than the melting point of said thermoplastic resin to crosslink said polymer and which is solid at room temperature, and a blowing agent capable of decomposing and generating a gas when heated to a temperature higher than the melting point of said thermoplastic resin.

5. A method according to claim 3, wherein before step (f) the powder coating composition remaining unadhered in said tubular metal body is removed therefrom through said opening.

* * * * *